United States Patent [19]

Borner

[11] 4,167,390

[45] Sep. 11, 1979

[54] INSTALLATION FOR BURNING MATERIALS

[76] Inventor: Raoul Borner, Postfach 59, 7320 Sargans, Switzerland

[21] Appl. No.: 766,065

[22] Filed: Feb. 4, 1977

[51] Int. Cl.[2] ..... F27B 15/00

[52] U.S. Cl. ..... 432/58; 432/95

[58] Field of Search ..... 432/58, 95, 13, 14, 432/16

[56] References Cited

U.S. PATENT DOCUMENTS

| | | | |
|---|---|---|---|
| 3,447,789 | 6/1969 | Sharp | 432/13 |
| 3,511,485 | 5/1970 | Mack | 432/58 |
| 3,832,430 | 8/1974 | Noziere | 432/58 |
| 3,911,594 | 10/1975 | McIntire | 432/58 |
| 4,057,908 | 11/1977 | Mirliss et al. | 432/58 |

*Primary Examiner*—John J. Camby

*Attorney, Agent, or Firm*—Neil F. Markva

[57] ABSTRACT

A process and an apparatus is used for burning crushed raw powder to effect deacidifying, sintering or melting minerals in said powder. The process comprises the steps of providing a closed, elongated furnace chamber and establishing and maintaining a current of gas from one end of the furnace chamber to the other end thereof at a negative pressure. Combustion is effected in at least one zone of the chamber for burning the raw powder to form a burnt reaction product. The burnt product is separated from the current of gas under negative pressure. The assembly used to effect the process includes a mixing tube fitted with a mechanism for introducing atmospheric air to be mixed with the raw powder before entering the elongated furnace chamber. Other specific mechanisms are used to transfer the raw powder through the entire assembly for treatment thereof.

19 Claims, 1 Drawing Figure

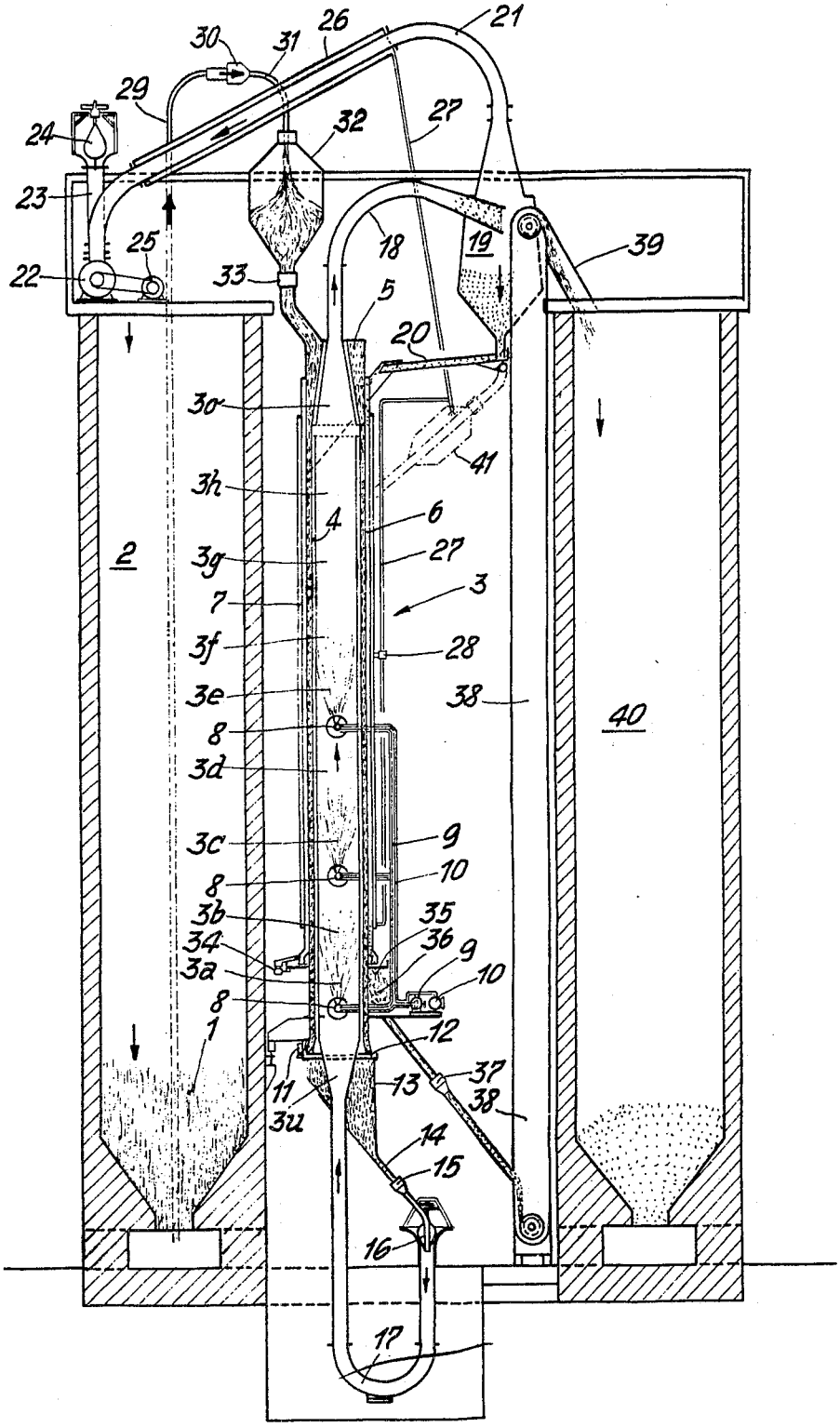
21
26
30
31
29
24
32
27
23
25
22
33
18
19
39
5
20
3o
41
3h
4
6
2
3g
27
7
3
3f
28
3e
38
40
8
3d
3c
9
10
8
3b
35
34
36
9
3a
10
8
1
12
11
13
37
3u
38
14
15
16
17

INSTALLATION FOR BURNING MATERIALS

BACKGROUND OF THE INVENTION

The invention concerns a process for burning minerals for the purpose of deacidifying, sintering or melting, and an installation for carrying out the process.

Hitherto, minerals extracted by surface working, semi-surface working and underground working, such as natural binding agents, iron, copper and silver ores, etc., in grain sizes from about 10 to 200 mm, have been burnt in shaft, circular chamber, rotating or specialized furnaces. This involved a variety of disadvantages, some of them serious:

A rotary furnace for a daily output of about 700 t is up to some 130 m long and, at about 1 rpm, has a diameter of up to 4.0 m. The radiation and heat loss of such a furnace, even when the best heat recovery equipment is used, is around 29%, and a piece of a grain size of about 20 mm requires some 20 to 35 hours to pass through the furnace. A rotary furnace requires between 1350 and 1800 kgcal/kg of burnt product emerging.

In a shaft furnace, larger grain sizes, at least 30 mm, have to be processed, and here, the heat losses today amount to about 21% and the heat consumption lies between 900 and 1200 kgcal/kg. The transit time of a piece is about 32 hours, depending on the raw material and the performance of the type of furnace in question.

The costs of manufacture of existing furnaces are relatively high. A rotary furnace costs up to 30 million francs and a shaft furnace with much the same output about 6 million francs.

All known types of furnace at pressures up to 300 mm water column (corresponding to 0.3 atu) and a grain size of 20 to 200 mm. However, as every specialist knows, limestone forms a calcined skin on its surface during burning, which has a highly heat-insulating effect and allows heat to penetrate into the interior of the stone only with difficulty. The burnt skin hinders or slows down the solid body reactions. In consequence, the stone has to be exposed to the prolonged action of heat until it is completely burnt through; by then, however, the outer skin is usually damaged (overburnt) or it breaks down into a fine powder which clogs the furnace, settles on the other stones and insulates them, as long as the furnace is in operation.

Rotary and shaft furnaces also consume an exceptionally large amount of power and, even with maximum automation, require at least one man per shift. In addition, it is impossible to start up such a furnace within a shorter period than 3 days, and it is also not easy to shut it down again. Costs are extremely high and starting up usually calls for special expenditure. Furthermore, a conventional furnace, of whatever design, can be used for one or two binding agents only; its location is fixed and it weighs about 1500 t, often more.

Finally, every known type of furnace can be used only for a specific grain size, with the result that, in every factory, a certain proportion of much finer grain occurs in the waste. This fine grain can be used for only very few other purposes and therefore realises only a very low price (what are known as give-away prices). In the majority of plants, this material lies around in vast quantities and clutters up the limited space, although it is, basically, the best raw material.

SUMMARY OF THE INVENTION

The aim underlying the invention is the acceleration of calcination in the burning of minerals, to reduce the power consumption and the simplification of the subsequent crushing, to mention only these few important advantages.

In the process according to the invention, this object is achieved in that the raw powder or pulp is carried in a current of gas, especially a current of air, in at least one combustion zone of a largely elongated furnace chamber, and through it, this chamber being maintained at a reduced pressure, and that, on conclusion of the reaction, the reaction product is precipitated from the current of gas.

The installation for carrying out the process is characterized by a crushing and grinding plant for the won minerals, a raw powder silo, an elongated suspension furnace with a fireproof lining and at least one burner, one end of this furnace being connected to a mixing tube, fitted with an inlet valve, for the raw powder or raw pulp, and its other end, via a sifter for the product of burning, to the suction pipe of an exhaust fan and to a silo for the product of burning.

The characteristic features of the process according to the invention is that a uniform burning grain (preferably not more than 1.0 mm) is used for the combustion process, which can be burnt very rapidly and much better than a coarser grain and does not give rise to any dust deposit. The air, which acts as a carrier, is a poor conductor of heat, so that heat losses from waste gas and radiation remain low. The design of the installation is extremely simple, and the furnace can be easily dismantled at any time, converted within two hours at the most and, when required, shut off or started up again. With this furnace, all natural binding agents—for the first time—a new natural cement can be produced; in addition, this furnace permits talcum, iron ore, copper ore, etc., to be satisfactorily pre-processed.

In the main, the advantages of the process are as follows: because of the negative pressure, precipitation of the $CO_2$ takes place more quickly and requires less heat for calcination. The direct impact of heat on the solid material in the gas current prevents the formation of the burnt skin and speeds up the reaction. The cross-section of flow produced in the elongated furnace results in a grading of the grain fractions (a short period of dwell for fine grains, a long period of dwell for coarse grains). No caking or sintering of the solid matter and the large specific surface area of the grains is retained. The subsequent grinding process is simplified because no lumps of clinker are formed. The advantages described, especially the simple operation of the furnace, which dispenses with the need for automation, and the absence of any waste, more than outweigh the additional cost of grinding the won minerals.

BRIEF DESCRIPTION OF DRAWING

In the drawing, the invention is explained with the aid of one example of a version of the installation.

DESCRIPTION OF SPECIFIC EMBODIMENTS

The installation for carrying out the process in accordance with the invention, as shown in the drawing, comprises a vertical suspension furnace 3, a raw powder silo 2, burnt products silo 40 and means for moving the particulate material through the installation. The crushing and grinding plant for the won minerals is not shown, because it is of a familiar type. The raw powder 1 is crushed and ground minerals having a grain size of not more than 1.0 mm. The raw powder 1 is fed into raw powder silo 2. Vertical suspension furnace 3 is located alongside or below raw powder silo 2. Suspension furnace 3 is made up of several circular lengths of piping 3*a* through 3*h*, detachably connected to one another. Each length of piping 3*a* through 3*h* has an internal cross-section of 1 $m^2$. Alternatively, furnace 3 can be made in only one section and have an internal cross-section of a different size and/or shape.

Furnace 3 includes an upper diffuser end 30 and a lower diffuser end 3*u*. Over almost the whole of its length, furnace 3 is lagged with a fireproof lining 4 and is surrounded by a preheating jacket 5. Jacket 5 has the shape of a circular cylinder and is enveloped over the greater part of its length by a heat recovery jacket 6. Alternatively, jacket 5 may also take the form of a coiled tube. Heat recovery jacket 6 is, in turn, surrounded over the greater portion of its length by a cooling water jacket 7. The cooling water flowing through jacket 7 carries away the excess heat obtained in the combustion process.

Three oil burners 8 are located at different heights along the length of suspension furnace 3. More than 3 burners may be used and gas burners may be used instead of oil burners. Compressed air is fed to the special burners 8 through a compressed air line 10 and atomizes the crude oil or gas reaching burners 8 via pipe line 9. An electromotor 11 drives a rotatable extractor tray 12 fitted to the lower end of preheating jacket 5. A buffer silo 13 is located below tray 12. A pipe line 14 leads from silo 13 via a cellular valve 15 into an inlet valve 16 at the top of one of the arms of a U-shaped mixing tube 17. The other arm of tube 17 enters the lower diffuser end 3*u* of furnace 3.

A pipe line 18 leads from the upper diffuser end of furnace 3 into a sifter 19. The lower end of sifter 19 is connected via a vibrator 20 to heat recovery jacket 6. A suction pipe 21 leads from the upper end of sifter 19 to the exhaust connection of a fan 22. The pressure line 23 of fan 22 leads either into the open air or into a $CO_2$ recovery installation via an exhaust valve 24. An electromotor 25 drives fan 22. Suction pipe 21 is surrounded by a cooling water jacket 26 over at least a portion of its length. Jacket 26 is connected via a pipe line 27 with the cooling water jacket 7 of furnace 3. The cooling water is circulated by a cooling water pump 28.

The suction pipe 29 of a feed pump 30 runs upwardly from the lower end of raw powder silo 2. Pressure line 31 of pump 30 leads into an anterior silo 32. Anterior silo 32 is connected via a cellular valve 33 to the upper end of preheating jacket 5. An electromotor 34 drives a rotatable extraction device 35 located at the lower end of heat recovery jacket 6. A buffer silo 36 is located below extraction device 35. A pipe runs from the bottom end of buffer silo 36 via a cellular valve 37 into a conveyor system 38 which, in the example shown, is a bucket elevator. The conveyor system 38 may also be pneumatically operated. A pipeline 39 runs from the upper end of conveyor system 38 into a silo 40 for the products of combustion. The raw powder silo 2 and the burnt product silo 40 may be made of concrete or steel and have a cross-section which may be either circular or rectangular, preferably square.

A specific embodiment of the process according to the invention is carried out with the aid of the installation described above. Suspension furnace 3 is started up by igniting burners 8 and switching on the electromotors 11, 25 and 34. These electromotors are preferably operated on direct current because of the greater ease of controlling the speed of rotation effected thereby. The start-up further includes setting the feed pump 30 and the conveyor system in motion.

Feed pump 30 conveys raw powder 1 from silo 2 to the anterior silo 32 via suction pipe 29 and pressure line 31. The raw powder passes from silo 32 via the cellular valve 33 into the upper end of preheating jacket 5. By reason of its own weight, the raw powder trickles downwardly inside the jacket 5. Thus, the downwardly trickling powder is preheated in an exchange of heat by its contact with the hot furnace jacket 5. The preheated raw powder emerges from the lower end of jacket 5 and passes into the buffer silo 13 via rotating extractor tray 12 and, then, through pipe line 14 and cellular valve 15 into inlet valve 16.

Inlet valve 16 is under suction from fan 22. That is, once a current of gas is established from one end of the furnace 3 to the other end thereof, the inner chamber is maintained at a negative pressure. Depending on the setting of inlet valve 16 a given quantity of air is drawn in from the outside atmosphere. The jet effect caused thereby carries with it the quantity of raw powder predetermined by the infinitely adjustable cellular valve 5. The mixture of air and raw powder passes through mixing tube 17 into the lower diffuser end 3*u* of suspension furnace 3. Because of the shape of lower diffuser end 3*u*, the velocity of the air in furnace 3 is somewhat reduced thereby favoring the process of combustion.

The crude oil is preheated before being atomized. It is possible to make use of cooling water jacket 26 to preheat the crude oil instead of cooling water. In contrast thereto, the air flowing in through inlet valve 16 should be as cold as possible. The cold air serves not only to supply oxygen for the crude oil but also as a carrier for the raw powder and as a coolant for suspension furnace 3.

The raw powder carried along by the air is consumed instantaneously by the burning crude oil atomized in jets 8. The powder passes from bottom to top through the suspension furnace 3 in the current of gas. The resultant burnt product reaches the sifter 19 via the pipe line 18 and passes through vibrator 20 and into heat recovery jacket 6. As the still hot product of combustion trickles downwardly through jacket 6, it gives up some of its heat to the raw powder trickling downwardly in the adjacent preheating jacket 5. The remainder of the heat from jacket 6 goes to the cooling water in jacket 7.

The cooled burnt product flows from the lower end of heat recovery jacket 6 onto rotating extraction device 35 and passes into buffer silo 36. The burnt product passes from buffer silo 36 into the conveyor system 38 via a cellular valve 37 and is carried upwardly through pipe line 39 into burnt product silo 40. By means of appropriate adjustment of valves 16 and 24, burners 8, electromotors 11, 25 and 34, feed pump 30 and the infinitely adjustable cellular valves 15, 33 and 37, the process of combustion can be regulated to maximum efficiency. That is, operation with the smallest possible heat losses.

These are other alternative structures available for the installation and useful in the process of this invention. The diffusion furnace may be equipped with a slaking unit 41 indicated with dot-dash lines in the drawing. It may be advantageous in large installations to have the suspension furnace 3 built so that it can travel between a battery of raw powder silos 2 and a battery of burnt product silos 40. The respective batteries would be arranged in a row and standing in a parallel relationship with respect to each other with the suspension furnace 3 including its accessories, moving therebetween. It is also possible to link one to four furnaces in parallel so that they may form a production battery.

While the process for burning minerals and installation for carrying out the process has been shown and described in detail, it is obvious that this invention is not to be considered as being limited to the exact form disclosed, and that changes in detail and construction may be made therein within the scope of the invention, without departing from the spirit thereof.

I claim:

1. An assembly for burning crushed raw powder to effect acidifying, sintering or melting minerals in said powder, said assembly comprising:
(a) a closed, elongated furnace chamber,
(b) means for establishing a current of gas from one end of the furnace chamber to the other end thereof,
(c) means for maintaining the current of gas at a negative pressure,
(d) means for effecting combustion in at least one zone of said chamber for burning the raw powder to form a burnt reaction product,
(e) means for separating the burnt product from the current of gas under negative pressure, and
(f) means for introducing raw powder into said furnace chamber from a raw powder silo,
(g) said raw powder introducing means including an anterior silo and a suction pipe means for directing raw powder from said raw powder silo into said anterior silo.

2. An assembly as defined in claim 1 wherein
the closed suspension furnace is vertically disposed and tube shaped, and
said combustion effecting means includes at least two burners fitted centrally of said chamber at various heights along said furnace.

3. An assembly as defined in claim 1 wherein
said current establishing means includes a mixing tube having an inlet valve for introducing atmospheric air into a supply of raw powder.

4. An assembly as defined in claim 1 wherein
said current maintaining means includes a suction means for drawing material at said other end of the furnace chamber and
said separating means includes a sifter means for removing the burnt product from the current of gas after it has passed out of said furnace chamber.

5. An assembly as defined in claim 4 wherein
at least one silo is disposed adjacent said furnace chamber to receive burnt product from said sifter means.

6. An assembly as defined in claim 1 wherein
said current maintaining means includes a suction pipe and a pump for drawing gas out of said furnace chamber, and
a cooling water jacket surrounds said suction pipe means.

7. An assembly as defined in claim 1 wherein
a plurality of infinitely adjustable cellular valve means are disposed to maintain the current of gas through the assembly.

8. An assembly as defined in claim 1 wherein
said combustion effecting means includes oil burners operated by compressed air.

9. An assembly as defined in claim 1 wherein
said combustion effecting means includes a plurality of burners arranged as multiple ring burners located one above the other within said furnace chamber.

10. An assembly as defined in claim 1 wherein
said raw powder is supplied from a raw powder silo, and
said burnt product is disposed in a burnt product silo,
said raw powder silo and said burnt product silo being laterally spaced with respect to each other,
said closed elongated furnace chamber being located between said laterally spaced silos.

11. An assembly for burning crushed raw powder to effect acidifying, sintering, or melting minerals in said powder, said assembly comprising:
(a) a closed, elongated furnace chamber,
(b) means for establishing a current of gas from one end of the furnace chamber to the other end thereof,
(c) means for maintaining the current of gas at a negative pressure,
(d) means for effecting combustion in at least one zone of said chamber for burning the raw powder to form a burnt reaction product,
(e) means for separating the burnt product from the current of gas under negative pressure,
(f) said furnace chamber being surrounded by a preheating jacket,
(g) means for introducing raw powder into said preheating jacket to preheat said raw powder before it enters into said furnace chamber,
(h) an annular cylindrical heat recovery jacket is disposed around said preheating jacket, and
(i) means for introducing burnt product immediately after being removed from the furnace chamber,
(j) said burnt product introducing means including a vibrator means to direct the burnt product into said heat recovery jacket.

12. An assembly as defined in claim 11 wherein
said preheating jacket is in the form of a coiled tube.

13. An assembly as defined in claim 11 wherein
said preheating jacket is in the form of an annular cylinder.

14. An assembly for burning crushed raw powder to effect acidifying, sintering, or melting minerals in said powder, said assembly comprising:
(a) a closed, elongated furnace chamber,
(b) means for establishing a current of gas from one end of the furnace chamber to the other end thereof,
(c) means for maintaining the current of gas at a negative pressure,
(d) means for effecting combustion in at least one zone of said chamber for burning the raw powder to form a burnt reaction product,
(e) means for separating the burnt product from the current of gas under negative pressure,
(f) a preheating jacket is disposed around said suspension furnace,
(g) an annular cylindrical heat recovery jacket is disposed around said preheating jacket
(h) means for introducing burnt product into said heat recovery jacket immediately after passing out of said furnace chamber, and (i) a rotatable extractor device disposed below said heat recovery jacket to direct the burnt product into a buffer silo located immediately below said rotatable extractor device.

15. An assembly as defined in claim 14 wherein a conveyor system directs burnt product from said buffer silo into a burnt product silo.

16. An assembly as defined in claim 15 wherein said conveyor system operates mechanically.

17. An assembly as defined in claim 15 wherein said conveyor system comprises a bucket elevator.

18. An assembly as defined in claim 15 wherein said conveyor system operates pneumatically.

19. An assembly for burning crushed raw powder to effect acidifying, sintering, or melting minerals in said powder, said assembly comprising:

(a) a closed, elongated furnace chamber, (b) means for establishing a current of gas from one end of the furnace chamber to the other end thereof, (c) means for maintaining the current of gas at a negative pressure, (d) means for effecting combustion in at least one zone of said chamber for burning the raw powder to form a burnt reaction product, (e) means for separating the burnt product from the current of gas under negative pressure, (f) said furnace chamber being surrounded by a preheating jacket, (g) means for introducing raw powder into said preheating jacket to preheat said raw powder before it enters into said furnace chamber, (h) an annular cylindrical heat recovery jacket is disposed around said preheating jacket, and (i) means for introducing burnt product immediately after being removed from the furnace chamber, (j) said burnt product introducing means including a vibrator means to direct the burnt product into said heat recovery jacket, (k) said heat recovery jacket being surrounded by a cooling water jacket.

* * * * *